US005426919A

United States Patent [19]

Natterer et al.

[11] Patent Number: 5,426,919

[45] Date of Patent: Jun. 27, 1995

[54] PACKAGING MACHINE

[75] Inventors: Johann Natterer, Legau; Elmar Ehrmann, Grönenbach, both of Germany

[73] Assignee: Multivac Sepp Haggenmuller KG, Wolfertschwenden, Germany

[21] Appl. No.: 58,773

[22] Filed: May 7, 1993

[30] Foreign Application Priority Data

May 15, 1992 [DE] Germany ..... 42 16 149.5

[51] Int. Cl.[6] ..... B65B 47/00

[52] U.S. Cl. ..... 53/559; 53/389.2; 198/841; 198/860.2

[58] Field of Search ..... 198/841, 860.2; 53/374.3, 374.5, 374.6, 559, 389.2; 493/477; 52/656.1, 720

[56] References Cited

U.S. PATENT DOCUMENTS

| | | | |
|---|---|---|---|
| 2,256,394 | 9/1941 | Lamel . | |
| 3,596,752 | 12/1968 | Garvey | 198/841 X |
| 3,805,486 | 4/1974 | Mahaffy et al. | 53/167 X |
| 4,366,663 | 1/1983 | Grebe | 53/559 |
| 4,399,908 | 8/1983 | Gunti | 198/860.2 |
| 4,556,143 | 12/1985 | Johnson | 198/841 |
| 4,649,693 | 3/1987 | Yeager | 53/389.2 X |
| 4,881,633 | 11/1989 | Cailey et al. | 198/860.2 X |
| 4,897,985 | 2/1990 | Buchko et al. | 53/559 |
| 4,951,809 | 8/1990 | Boothe et al. | 198/860.2 X |
| 4,961,492 | 10/1990 | Wiseman et al. | 198/841 |
| 5,060,788 | 10/1991 | Compton et al. | 198/841 X |

FOREIGN PATENT DOCUMENTS

| | | | |
|---|---|---|---|
| 963416 | 2/1975 | Canada | 198/860.2 |
| 2026626 | 11/1970 | France . | |
| 2111821 | 4/1972 | France . | |
| 2419808 | 6/1979 | France . | |

*Primary Examiner*—John Sipos
*Assistant Examiner*—Daniel Moon
*Attorney, Agent, or Firm*—Donald Brown

[57] ABSTRACT

A packaging machine comprises a frame, at least two work stations arranged behind each other and carried by the frame and transport means for advancing the packaging material. In order to simplify the manufacture and to reduce the weight of the frame parts the lateral frame parts have a substantially U-shaped cross-section having an upper cross-link and two downwardly directed sidewalls. The free ends of the sidewalls are connected by connecting members.

9 Claims, 5 Drawing Sheets

PACKAGING MACHINE

BACKGROUND OF THE INVENTION

The invention relates to a packaging machine and in particular to a packaging machine having a frame, at least two work stations arranged behind each other on the frame and transport means for advancing a packaging material.

Conventionally the frame of such packaging machines is manufactured from cast aluminum material or from aluminum profiles.

OBJECTS OF THE INVENTION

It is an object of the invention to provide an improved packaging machine. It is a further object to provide a packaging machine with a frame which can be produced in a particularly simple and flexible manner. It is a still further object of the invention to design the frame so as to be lighter than conventional frames.

SUMMARY OF THE INVENTION

In order to achieve the above-mentioned objects the invention provides a packaging machine comprising a frame, at least two work stations arranged behind each other and carried by said frame, transport means for advancing a packaging material web through said work stations, said frame having sidewalls of a substantially U-shaped cross-section, said sidewalls comprising two downwardly extending lateral sides and a transverse cross-link connecting said sides, connecting members being provided for connecting said lateral sides at a position spaced from said transverse cross-link.

BRIEF DESCRIPTION OF THE DRAWINGS

Further advantages, features and objects of the invention will stand out from the following description of an exemplary embodiment with reference to the drawings, wherein.

DESCRIPTION OF THE PREFERRED EMBODIMENT

Figure 1:
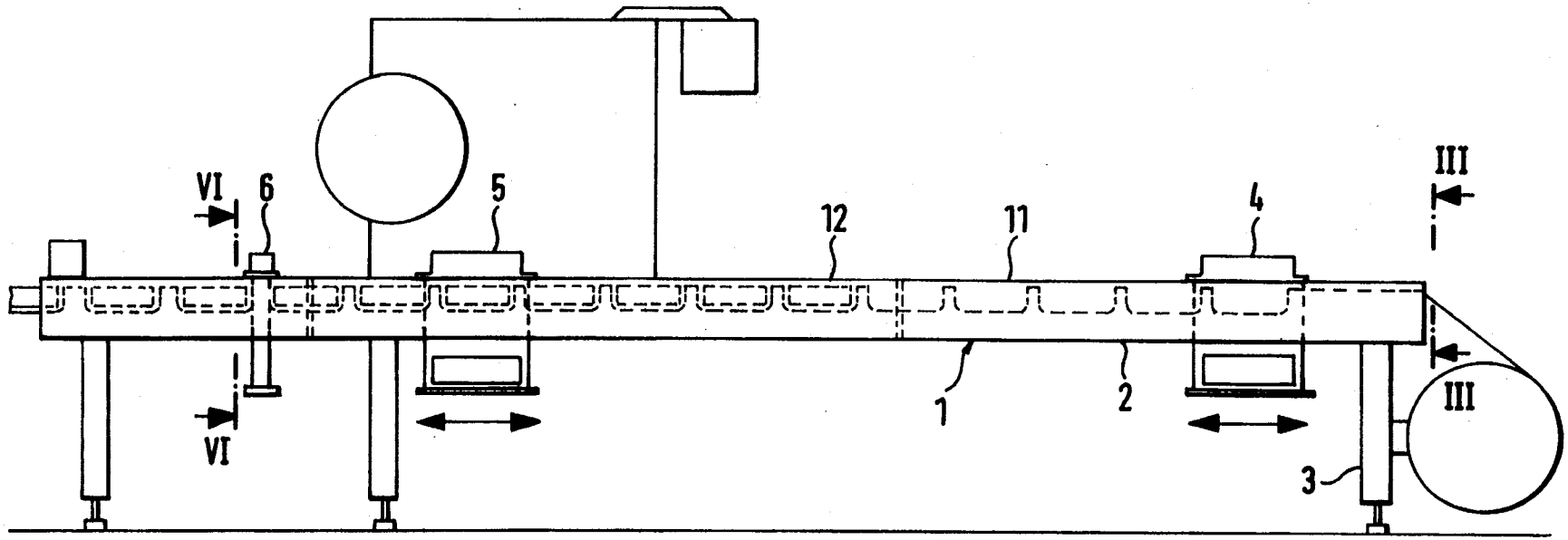
FIG. 1 is a schematic side view of a packaging machine with omitted sidewall.

As best shown in FIG. 1 the packaging machine comprises a frame 1 having sidewalls 15, 16 and stands 3 supporting the sidewalls. The frame supports a first work station 4 which is formed as a forming station, a second work station 5 which is formed as an evacuation-sealing means and a third work station 6 which is designed as a cutting means.

Figure 5:
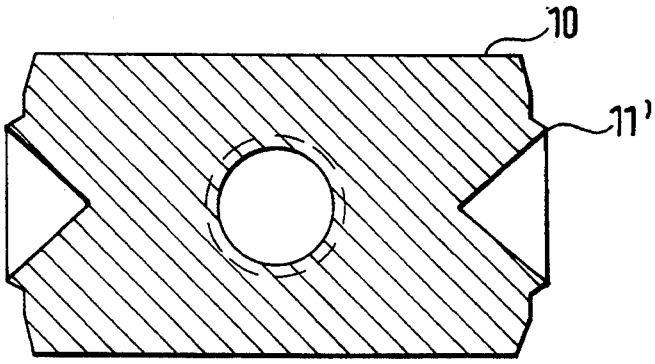
FIG. 5 shows a connecting member.

As may be best seen from FIG. 2 each of the sidewalls 15, 16 is formed as a profile having a substantially U-shaped cross-section. In order to obtain a high rigidity in a direction perpendicular to the longitudinal extension of the profile the two lateral sides 8, 9 of the profile are made relatively long compared with the dimension of the cross-link 10' connecting the two lateral sides 8, 9. Preferably sheet steel is used as base material for forming the profile. In order to increase the resistance of the profile against bending and twisting a plurality of spaced connecting members 10 are rigidly connected with the free ends of the sidewalls 8, 9. The connecting members can be connected to the free ends by gluing, screwing, welding or the like. FIG. 5 shows the cross-section of a connecting member which is prepared for a particularly advantageous resistance pressure welding by providing a corresponding annular projection 11'.

Figure 4:
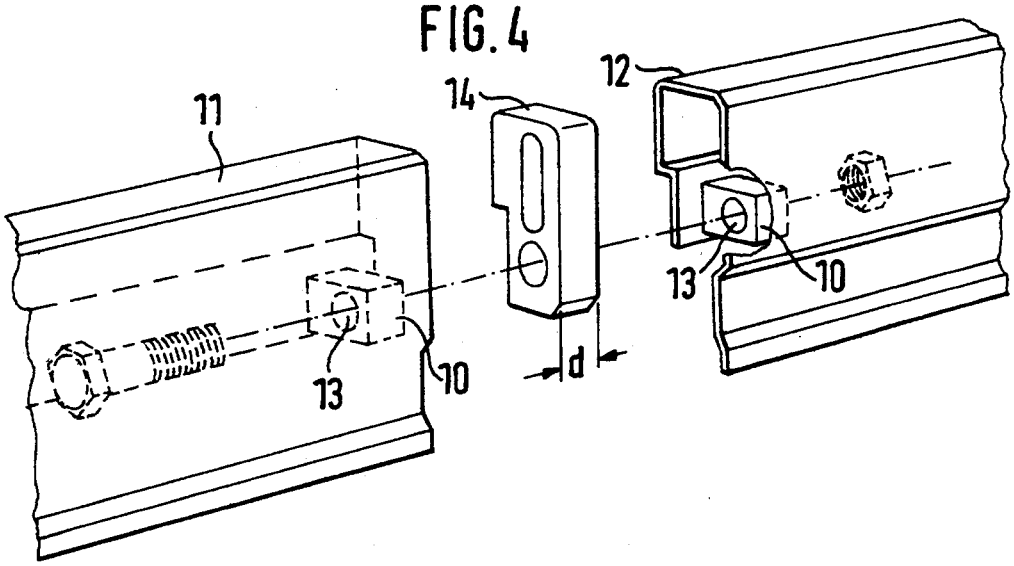
FIG. 4 is an exploded view of the connection of two profile members in detail.

As shown in FIG. 1 a sidewall of such a machine frame is composed of a plurality of profiled parts 11, 12, depending on the desired length. In order to enable the assembly a connecting member 10 is provided in a predetermined distance from the end face to be connected with the adjacent profiled part, the connecting member having a bore 13 extending in longitudinal direction of the profiled part. A corresponding connecting member having a corresponding bore is provided in the second profiled part at an identical predetermined distance from the end face thereof. A centering piece 14 is provided for connecting both parts and has an outer cross-section having a shape and dimensions which correspond to the inner cross-section of the profiled parts to be connected. The centering piece 14 has a corresponding bore at the place of the bores 13. The thickness of the centering piece is slightly smaller and at best equal to the sum of the distances between both connecting members 10 and the associated end faces. The connection of the adjoining profiled parts 11, 12 is made in the manner best shown in FIG. 4 by screwing together the ends through the connecting members 10 and the centering piece 14 therebetween.

Figure 2A:
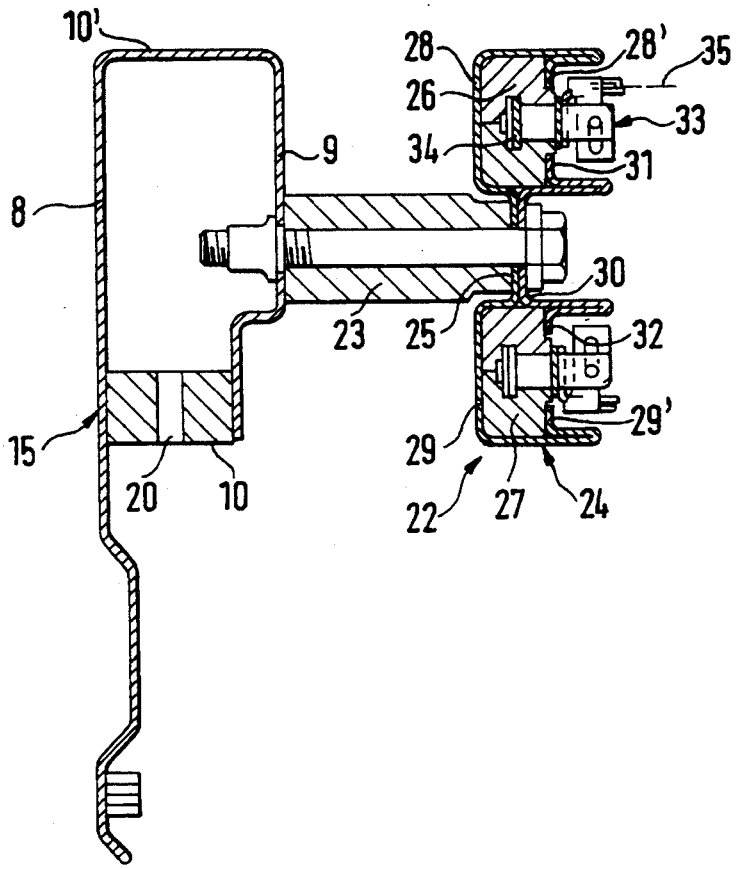
FIG. 2*a* is a sectional view of a frame sidewall and a part of a chain transporting mechanism.
Figure 3:
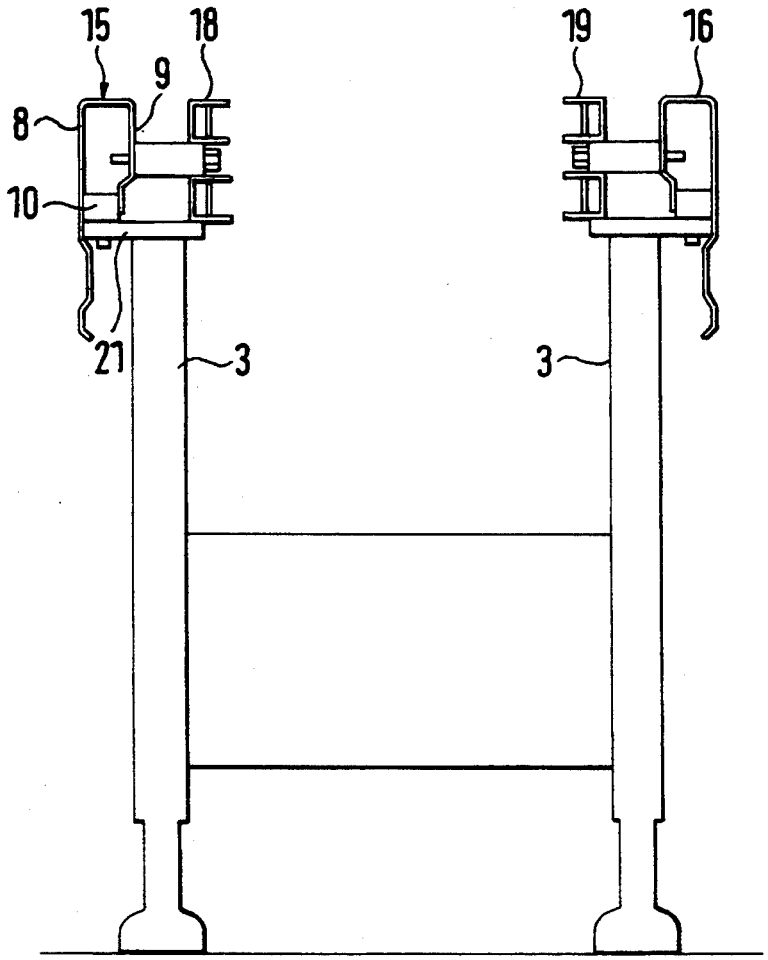
FIG. 3 is a front view through a frame with chain transporting mechanism in direction of the arrows III—III.

FIG. 3 shows a front view of the packaging machine along line III—III in FIG. 1 with omitted work stations. The packaging machine comprises a pair of sidewalls 15, 16 which are connected with a pair of stands 3 and each carry guides 18, 19 for endless chains. FIG. 2*a* is an enlarged representation of the one sidewall 15 together with the guides for the chains. At the connecting point with the stand 3 the corresponding connecting member 10 has a vertical bore 20 in place of the horizontal bore 13 for tightly screwing the connecting member to a part 21 of the stand 3.

Figure 2B:
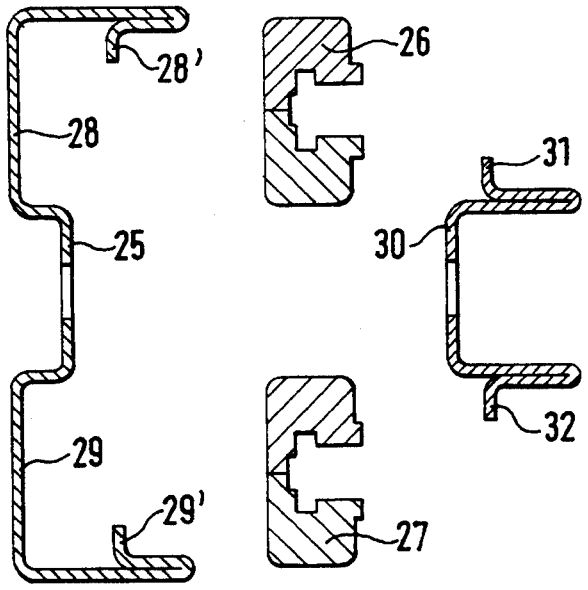
FIG. 2*b* is an exploded view of the part of the chain transporting mechanism shown in FIG. 2*a;*

A guide 22 which is best shown in FIG. 2*b* is tightly screwed to the inner lateral side 9 of the profiled part by means of a spacer bolt 23. The guide 22 comprises a support 24 having a bridging center part 25 and two C-shaped or clamp-shaped portions 28, 29 having a substantially rectangular cross-section. The longitudinal sides of the portions 28, 29 are aligned substantially parallel to the sidewalls 15, 16. The inner cross-section of the portions 28, 29 substantially corresponds to the outer cross-section of chain guide bars 26, 27 to be received therein. The lateral free ends 28', 29' of the portions 28, 29 are bent-over inwardly. The chain guide bars are inserted into the profiles of the portions 28, 29. They are retained by a center section which is substantially U-shaped and comprises a base portion 30 for connection with the center part 25 and lateral legs, whereby the free ends 31, 32 of the lateral legs are bent-over outwardly in the manner shown in FIG. 2*b* so as to fix the chain guide bars 26, 27 within the portions 28, 29 in cooperation with the inwardly bent free ends 28', 29' of the portions 28, 29. The chain guide bars comprise longitudinal slits for guiding the rollers 34 of the endless chain 33 therein. In conventional manner the chain comprises clamps for engaging a packaging material web 35 to be passed through the machine.

Figure 6A:
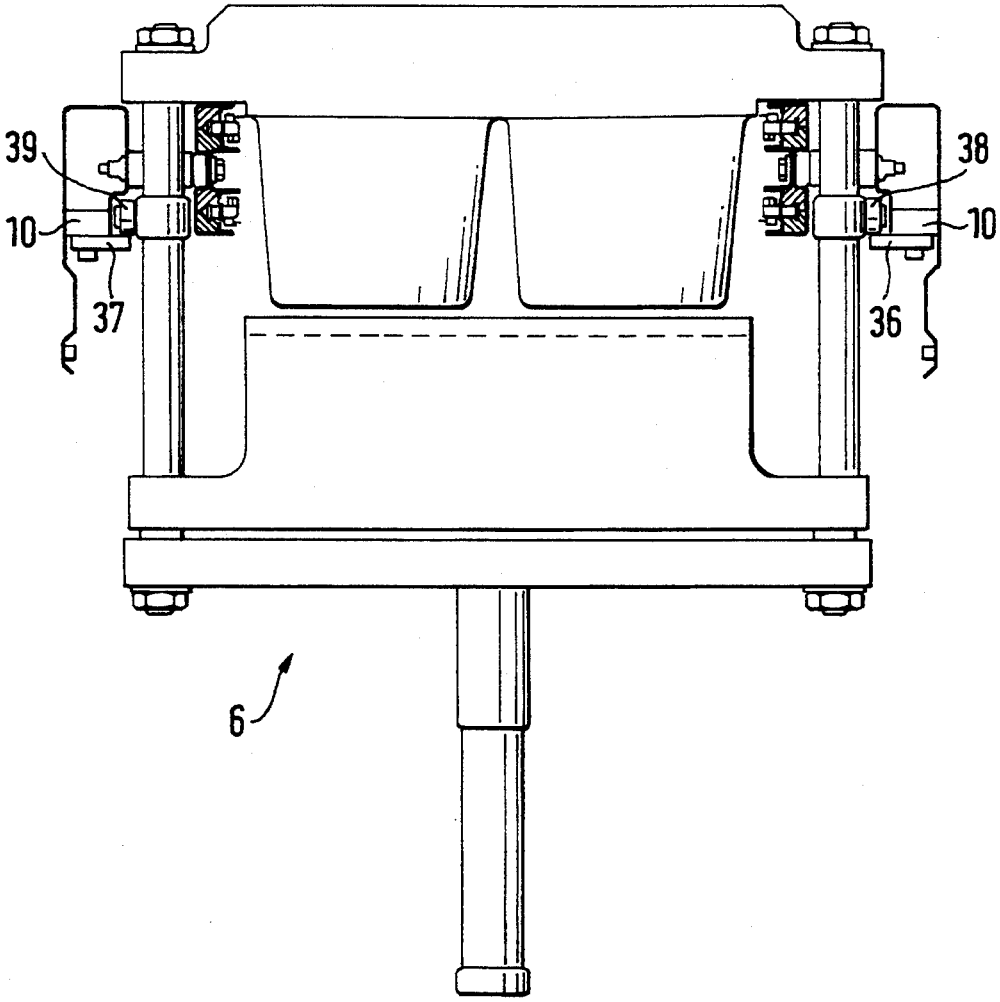
FIG. 6*a* is a sectional view along line VI—VI in FIG. 1.
Figure 6B:
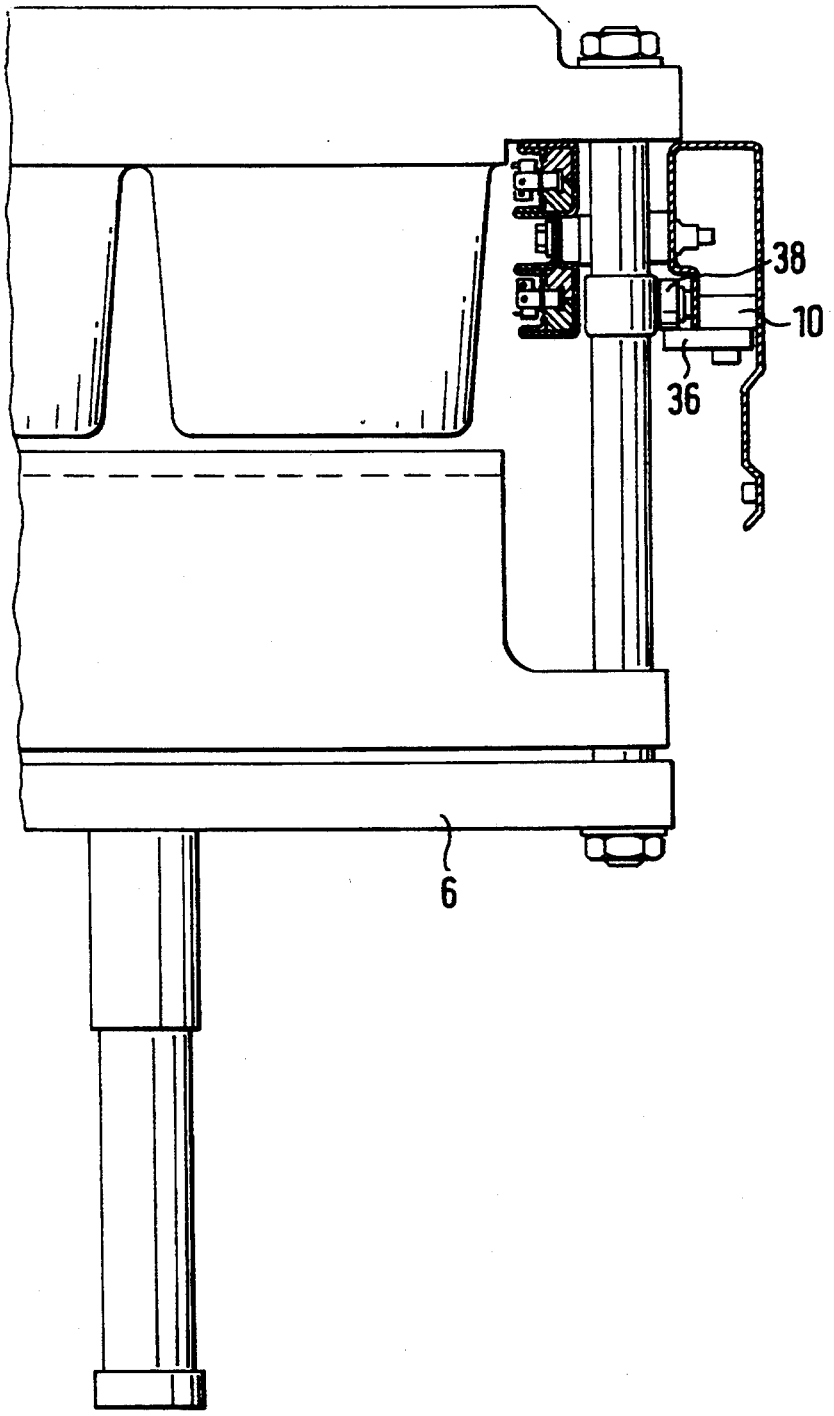
FIG. 6*b* shows part of the FIG. 6*a* in enlarged representation.

As best shown in FIGS. 6*a* and 6*b* rail-type strips 36, 37 are provided at those regions where the work stations 4, 5, 6 are disposed and rigidly connected to the connecting members 10 by means of bolts passing through vertical bores within the connecting members. The work stations have wheels 38, 39 mounted at the sides of the frames thereof and supported on horizontal shafts. The wheels support the work stations on the rail-type strips 36, 37 so that the work stations may be reciprocally displaced in longitudinal direction of the frame within a predetermined rail section for adaption to particular sizes of the packages.

While the invention has been described in preferred form it is not limited to the precise nature shown as various modifications may be made without departing from the scope of the appended claims.

What is claimed is:

1. Packaging machine comprising a frame having two opposite lateral sidewalls the corresponding free ends thereof defining an input side and an output side of said packaging machine; a first work station carried by said frame and arranged between the sidewalls in the vicinity of the input side; at least a second work station carried by said frame and arranged between the sidewalls behind said first work station in the direction of the output side; transport means for advancing a packaging material web through said work stations from the input side to the output side; said sidewalls having a substantially U-shaped cross-section and comprising two downwardly extending lateral sides and a transverse cross-link connecting said sides; connecting members for connecting said lateral sides at a position spaced from said transverse cross-link; and means for connecting said transport means and the rest of the frame to said sidewalls through said lateral sides and/or said connecting members.

2. The packaging machine of claim 1, wherein a length of said lateral sides is greater than a width of said interconnecting cross-link.

3. The packaging machine of claim 2, wherein said connecting members are mounted at a free end of said lateral sides.

4. The packaging machine of claim 1, comprising bores provided within said connecting members.

5. The packaging machine of claim 1, comprising profiled parts provided at said inner lateral sides of said sidewalls and having guides for guiding a pair of endless chains.

6. The packaging machine of claim 5, said guides each having a center part and first clamp-shaped portions at both sides of said center part, an inner cross-section of said clamp-shaped portions corresponding to an outer cross-section of chain guide bars inserted therein for guiding rollers of said endless chains, said guides further comprising a second substantially clamp-shaped portion which is connected to said center part and comprises lateral portions locking the guide bars in the first clamp-shaped portions when inserted.

7. The packaging machine of claim 1, comprising roller rail members carried by said connecting members for receiving rollers of a work station.

8. The packaging machine of claim 1, comprising at least two partial members forming each of said sidewalls and being aligned in a longitudinal direction, a connecting member provided in each of said partial members at a predetermined small distance from the free ends thereof to be connected, said connecting members comprising a bore extending in the longitudinal direction of said partial members, a centering piece having an outer shape which corresponds to an inner cross-section of said partial members and having a thickness which corresponds to a sum of both predetermined distances, the centering piece further having a bore corresponding to said bore within said connecting members, said partial members being interconnected by connecting said connecting members facing each other with said centering piece therebetween.

9. The packaging machine of claim 1 wherein a length of said lateral sides is at least twice as large as a width of said interconnecting cross-link.

* * * * *